US006646540B1

(12) United States Patent
Lussey

(10) Patent No.: US 6,646,540 B1
(45) Date of Patent: Nov. 11, 2003

(54) CONDUCTIVE STRUCTURES

(75) Inventor: David Lussey, Richmond (GB)

(73) Assignee: Peratech Limited, Darlington (GB)

( * ) Notice: Subject to any disclaimer, the term of this patent is extended or adjusted under 35 U.S.C. 154(b) by 0 days.

(21) Appl. No.: 10/018,400

(22) PCT Filed: Jun. 21, 2000

(86) PCT No.: PCT/GB00/02402

§ 371 (c)(1),
(2), (4) Date: Dec. 19, 2001

(87) PCT Pub. No.: WO00/79546

PCT Pub. Date: Dec. 28, 2000

(30) Foreign Application Priority Data

| | | |
|---|---|---|
| Jun. 22, 1999 | (GB) | 9914399 |
| Jul. 1, 1999 | (GB) | 9915296 |
| Aug. 10, 1999 | (GB) | 9918837 |
| Feb. 10, 2000 | (GB) | 0002912 |

(51) Int. Cl.[7] ..... H01C 10/10

(52) U.S. Cl. ..... 338/47; 338/99; 338/114; 338/2

(58) Field of Search ..... 338/2, 20, 21, 338/47, 5, 99, 101, 114

(56) References Cited

U.S. PATENT DOCUMENTS

| | | | | |
|---|---|---|---|---|
| 1,455,735 A | * | 5/1923 | Rojas | 338/99 |
| 2,042,606 A | * | 6/1936 | Kotowski | 338/101 |
| 2,375,178 A | * | 5/1945 | Ruben | 338/101 |
| 2,472,214 A | * | 6/1949 | Hurvitz | 338/99 |
| 2,951,817 A | * | 9/1960 | Myers | 338/114 |
| 3,125,739 A | * | 3/1964 | Deibel et al. | 338/99 |
| 3,629,774 A | * | 12/1971 | Crites | 338/114 |
| 4,054,540 A | * | 10/1977 | Michalchik | 252/512 |
| 4,145,317 A | * | 3/1979 | Sado et al. | 338/114 |
| 4,258,100 A | * | 3/1981 | Fujitani et al. | 338/114 |
| 4,292,261 A | * | 9/1981 | Kotani et al. | 264/437 |
| 4,529,959 A | * | 7/1985 | Ito et al. | 338/295 |
| 4,790,968 A | * | 12/1988 | Ohkawa et al. | 264/104 |
| 5,060,527 A | * | 10/1991 | Burgess | 73/862.68 |
| 5,393,597 A | * | 2/1995 | Childers et al. | 442/110 |
| 5,692,118 A | * | 11/1997 | Yasukawa | 396/153 |

* cited by examiner

*Primary Examiner*—Karl D. Easthom
(74) *Attorney, Agent, or Firm*—Larson & Taylor, PLC

(57) ABSTRACT

A conductive structure is used in electric variable resistance devices to provide changes in electrical resistance with movement and changes in pressure, the variable resistance device comprising externally connectable electrodes (10) bridged by an element (14) containing polymer and particles of metal, alloy or reduced metal oxide, said element (14) having a first level of conductance when quiescent and being convertible to a second level of conductance by change of stress applied by stretching or compression or electric field, the device further comprising by means (18) to stress the element (14) over a cross-sectional area proportional to the level of conductance required.

28 Claims, 3 Drawing Sheets

CONDUCTIVE STRUCTURES

TECHNICAL FIELD

This invention relates to conductive structures used in electric variable resistance devices to provide changes in electrical resistance with movement and changes in pressure. The structures can also provide electrical isolation and shielding and allow a start resistance to be set. Further, they can provide a leakage path for electrostatic voltages, add a degree of movement and tactility to operation and in preferred forms can respond to the presence of chemical, biological or radioactive species.

BACKGROUND ART

Reference is made to prior applications: A: PCT/GB98/00206, published as WO 98/33193; and B: PCT/GB99/00205, published as WO 99/38173, which disclose polymer compositions having the electrical property of insulation when quiescent but conductance when stressed mechanically or in electric fields. Typically, in a high resistance state (typically $10^{12}$ ohm. cm), they change to a low resistance state (typically milliohm. cm) by the application of such stress. It appears that the effective resistance of the polymer component phase is reduced owing to electron-tunnelling and carrier trapping. When in such a state, the polymer composition is able to carry high electric current densities, even though there are no complete metallic pathways, i.e. the composition is below the percolation threshold. The disclosure of these prior applications is incorporated herein by reference and extracts therefrom are quoted hereinbelow. The invention may use materials described therein but is not limited thereto.

SUMMARY OF THE INVENTION

According to the invention in its first aspect an electric variable resistor comprises externally connectable electrodes bridged by an element containing polymer and particles of metal, alloy or reduced metal oxide, said element having a first level of conductance when quiescent and being convertible to a second level of conductance by change of stress applied by stretching or compression or electric field, characterised by comprising means to stress the element over a cross-sectional area proportional to the level of conductance required.

In this specification:

- the term 'variable resistor' may include a switch, because the range of resistance available may amount to open circuit; and
- the particles of metal, alloy and reduced metal oxide, whether encapsulated by polymer or not, and whether stressed or stressable to conductance, will be referred to as 'strongly conductive';

The stressing means may comprise an actuator having variable geometry at the site of application, for example an oblique shoe or a selectively activatable array of pins or radiation beam sources. A variable resistor preferred for simplicity comprises the element and, matching the cross section thereof, a layer composed of insulating or weakly conductive material and containing interstices accessible to mobile fluid. (Mobile fluid need not in fact be present, e.g. the variable resistor may be operated in a vacuum). More particularly the element may be of a yielding consistency permitting penetration through the layer to an extent depending on an applied compression force. Preferably the element comprises a material that itself increases conductance when compressed.

The layer has a base structure selected suitably from foam, net, gauze, mat or cloth and combinations of two or more of these. The base structure and the material from which it is made affects, and may be chosen to suit, the physical and mechanical limits and performance of the overall structure and also for a moderating influence on the amount of creep normally associated with flexible conductive polymers.

Particularly useful layers comprise one or more of open-cell polymer foam, woven or non-woven textile e.g. felt, possibly with fibre/fibre adhesion, and 3-dimensional aggregations of fibre or strip.

The element may have a base structure of the same general type as the layer, but chosen to suit its particular function in the variable resistor. For example an element of collapsed structure may be used in combination with a non-collapsed layer, as described further below. Preferably the element base structure contains interstices accessible to mobile fluid.

The invention also provides, as a new article, a porous body having a base structure of polymer containing interstices accessible to mobile fluid and containing polymer and particles of metal, alloy or reduced metal oxide, said body having a first level of electrical conductance when quiescent and being convertible to a second level of conductance by change of stress applied by stretching or compression or electric field, characterised in that the base structure is a collapsed foam or cloth. Such a porous body may have at least one of the preferred features set out herein in relation to the variable resistor.

In the variable resistor the stressing means may be effective to for example: (a) apply conductance-increasing stress and/or (b) reverse such stress or act against pre-existing stress.

If the stressing means acts by compression or stretching, it may be for_example mechanical, magnetic, piezoelectric, pneumatic and/or hydraulic. Such application of stress can be direct or by remote control. If compressive, it may expel mobile fluid from the interstices of the element and/or layer. In a simple switch the fluid is air and the element and/or layer will be open to atmosphere. Whether mobile fluid is present or not, the element and/or layer may be resilient enough to recover fully alone or aided by a resilient operating member such as a spring. For reversing mechanical stress the element and layer may be set up in a closed system including means to force the mobile fluid into the interstices. Such a system may provide a means of detecting movement of a workpiece acting on the fluid outside the variable resistor.

The mobile fluid may be elastic, for example a non-reactive gas such as air, nitrogen or noble gas or possibly a readily condensable gas. Alternatively the fluid may be inelastic, for example water, aqueous solution, polar organic liquid such as alcohol or ether, non-polar organic liquid such as hydrocarbon, or liquid polymer such as silicone oil. In an important case the fluid is a test specimen to which the conductance of the variable resistor is sensitive.

Among the materials suitable for making the element and layer are:

for net, gauze, mat or cloth:

- hydrophobic polymers such as polyethylene, polyalkyleneterephthalate, polypropylene, polytetrafluoroethylene, polyacrylonitrile, highly esterified and/or etherified cellulose, silicone, nylons; and
- hydrophilic polymers such as cellulose (natural or regenerated, possibly lightly esterified or etherified), wool and silk;

for foam:

polyether, polystyrene, polypropylene, polyurethane (preferably having some plasticity), silicone, natural or synthetic rubber.

Whichever material is used for the element, it is preferably available in a form having relatively large interstices (e.g. 50–500 microns) and capable of collapse by compression by a factor of 2 to 8 leaving further compressibility.

Typically the element has 2 dimensions substantially greater than the third. Thus it is of a sheet-like configuration, for example the thickness 0.1 to 5, especially 0.5 to 2.0 mm. Its other dimensions are chosen to suit convenience in manufacture and user requirements, for example to permit contacting with a test specimen in a sensor according to the third aspect of the invention. If the element is to be stressed electrically, its cross-sectional area should be subdivided into electrically separate sub-regions, to permit the required partial activation. Preferably the element is anisotropic, that is, compressible perpendicularly to its plane but resistant to compression or stretching in its plane.

The content of strongly conductive material in the element is typically 500–5000 mg/cm$^3$. The size of the variable resistor can be chosen from an extremely wide range. It could be as small as a few granules of encapsulated metal; it could be part of a human movement area. In a useful example, since it can be made of flexible material, it may incorporated into a garment.

If the layer is to be weakly conductive, this may be due to containing 'semi' conductive materials, including carbon and organic polymers such as, polyaniline, polyacetylene and polypyrrole. The invention can be used to change the physical and electrical properties of these conductive materials. The weak conductance of the layer may, alternatively or additionally be due to a strong conductor, typically as present in the element, but at a lower content, for example 0.1 to 10% of the level in the element.

The element may contain weakly ('semi') conductive material as listed above. If the element has interstices, these may contain such a weak conductor, for example open-cell foam pre-loaded during manufacture with a semi-conductive filler to give a start resistance to a switch or variable resistor or to prevent the build up of static electricity on or within such a device.

The element and the layer, that is, the conductive and non-conductive strata, can be manufactured separately and placed over each other or held together using an adhesive—see FIG. 2*c* below. In an alternative—see FIG. 2*b* below—the layer may be integral with the element, the concentration of the strongly conductive material being graded. Thus an example of element and layer is a thin foam sheet which if stressed is capable of strong electrical conductance on one side whilst the opposite side remains electrically insulating or weakly conductive. The sheet can be produced by loading the interstices of a non-conductive open-cell foam sheet part of the way through its thickness with a strongly conductive powder or granule. This produces a conductive stratum of foam overlying a non-conductive stratum of foam. The conductive material can be kept in place within the foam sheet by an adhesive or by cross-linking the foam after loading.

In the variable resistor the strongly conductive material may be present in one or more of the following states:

a constituent of the base structure of the element;

(b) particles trapped in interstices and/or adhering to surfaces accessible to the mobile fluid;

(c) a surface phase formed by interaction of strongly conductive filler particles (i or ii below) with the base structure of the element or a coating thereon.

Whichever state the conductive material is present in, it may be introduced:

(i) 'naked'; that is, without pre-coat but possibly carrying on its surface the residue of a surface phase in equilibrium with its storage atmosphere or formed during incorporation with the element. This is clearly practicable for states (a) and (c), but possibly leads to a less physically stable element in state (b);

(ii) lightly coated, that is, carrying a thin coating of a passivating or water-displacing material or the residue of such coating formed during incorporation with the element. This is similar to (i) but may afford better controllability in manufacture;

(iii) polymer-coated but conductive when quiescent. This is exemplified by granular nickel/polymer compositions of so high nickel content that the physical properties of the polymer are weakly if at all discernible. As an example, for nickel starting particles of bulk density 0.85 to 0.95 this corresponds to a nickel/silicone volume ratio (tapped bulk:voidless solid) typically over about 100. Material of form (iii) can be applied in aqueous suspension. The polymer may or may not be an elastomer. Form (iii) also affords better controllability in manufacture than (i);

(iv) polymer coated but conductive only when stressed. This is exemplified by nickel/polymer compositions of nickel content lower than for (iii), low enough for physical properties of the polymer to be discernible, and high enough that during mixing the nickel particles and liquid form polymer become resolved into granules rather than forming a bulk phase. This is preferred for (b) and may be unnecessary for (a) and (c). An alternative would be to use particles made by comminuting material as in (v) below. Unlike (i) to (iii), material (iv) can afford a response to stress within each individual granule as well as between granules, but ground material (v) is less sensitive. In making the element, material (iv) can be applied in aqueous suspension;

(v) embedded in bulk phase polymer. This relates to (a) and (c) only. There is response to stress within the bulk phase as well as between interstice walls if present.

The strongly conductive material may be for example one or more of titanium, tantalum, zirconium, vanadium, niobium, hafnium, aluminium, silicone, tin, chromium, molybdenum, tungsten, lead, manganese, beryllium, iron, cobalt, nickel, platinum, palladium, osmium, iridium, rhenium, technetium, rhodium, ruthenium, gold, silver, cadmium, copper, zinc, germanium, arsenic, antimony, bismuth, boron, scandium and metals of the lanthanide and actinide series and if appropriate, at least one electroconductive agent. It can be on a carrier core of powder, grains, fibres or other shaped forms. The oxides can be mixtures comprising sintered powders of an oxycompound. The alloy may be conventional or for example titanium boride.

For (a) or (c) co-pending application A discloses and claims a composition which is elastically deformable from a quiescent state and comprises at least one electrically conductive filler mixed with a non-conductive elastomer, characterised in that the volumetric ratio of filler to elastomer is at least 1:1, the filler being mixed with the elastomer in a controlled manner, in a mixing regime avoiding destructive shear forces, whereby the filler is dispersed within and encapsulated by the elastomer and may remain structurally intact, the nature and concentration of the filler being such that the electrical resistivity of the composition is variable in response to compression or extension forces and decreases from a given value in the quiescent state towards a value substantially equal to that of the conductor bridges of the filler when subjected to either compression or extension forces, the composition further comprising a modifier which, on release of said forces, accelerates the elastic return of the composition to its quiescent state.

For (iii) and (b) a preferred composition, disclosed and claimed in co-pending application B, is an electrical conductor composite providing conduction when subjected to mechanical stress or electric charge but electrically insulating when quiescent comprising a granular composition each granule of which comprises at least one substantially non-conductive polymer and at least one electrically conductive filler and is electrically insulating when quiescent but conductive when subjected to mechanical stress or electric charge.

In naked conductor or in either such composition preferably the filler particles comprise metal having a spiky and/or dendritic surface texture and/or a filamentary structure. Preferably the conductive filler comprises carbonyl-derived metallic nickel. Preferred filler particles have a 3-dimensional chain-like network of spiky beads, the chains being on average 2.5 to 3.5 microns in cross section and possibly more than 15–20 microns in length. The polymer is preferably an elastomer, especially a silicone rubber, preferably comprising a recovery-enhancing modifier filler.

These and further details of the compositions are disclosed in the above cited co-pending applications. If conductive ingredients of form (iii) or (iv) are used, the granules thereof are preferably of a spiky and/or irregular and/or dendritic shape.

The invention provides methods of incorporating the conductive material into the element. Strongly or weakly conductive particles, especially of the preferred shapes may be put onto or into the interstices of foams or cloths and kept in place by bonding or mechanical or frictional constraint, e.g. with over-large particles in slightly smaller interstices. This can be done by simply mechanically compressing them in, or by suspending them in fluid, which is then passed through the foam or cloth. The foam or cloth may be further processed to make it shrink and provide a better grip of the particles. Other ways to ensure the granules remain in the element include bonding or coating film or sheet to one or more of its faces to provide a seal. If the film or sheet is electrically conductive, it also provides a means of ohmic connection.

In the shrinking method, the element base material containing interstices can be shrunk by using adhesives and applying pressure until set. Another means of shrinking the base material is to heat it and apply pressure. Many heat-formable foams and cloths have been found suitable for this type of treatment. The area to which the pressure is applied can be monitored for changes in electrical resistance to ensure a consistent product. As well as the amount of shrinkage, the type, size, amount and morphology of the particles used and the interstice size also have an effect on the pressure sensitivity and resistance range of the variable resistor. Dielectric layers can also be built in using the arrangement of a conductive stratum above a non-conductive stratum to produce a variable resistor with an inherent dielectric layer.

It has also been found that granules made with a non-elastomeric coating, e.g. an epoxy resin, will work in the element. It appears that the elastomeric nature of the base structure is sufficient for the invention to work, though the sensitivity to pressure is usually reduced and the electrical properties of the epoxy coated granules are different from those of silicone coated granules.

Whereas compression may be conveniently applied normal to the plane of a sheet-like element, such element can also display electrical conductance across its surface, e.g. on the side of a graded structure carrying conductive polymer composition, and this conductivity may be influenced by pressure if a pressure-sensitive conductive polymer, powder or granule is used. The other side of such a structure will display the normal high electrical resistance unless loaded with a conductive or semi-conductive filler during manufacture.

In such a variable resistor arranged as a pressure sensitive bridge across two or more ohmic conductors lying in the same plane, an increase in sensitivity may be afforded by coating the exposed back of the element with a fully conductive layer such as metallic foil or coating. This will promote the formation of a shorter conductive path through the element rather than across.

In a preferred variable resistor an externally connectable electrode is placed just touching the surface of the element and a corresponding electrode is placed opposite on the surface of the layer. In the absence of pressure on the electrodes, the element is in a quiescent state and is non-conductive. If pressure is applied to the electrodes, the element will conduct when forced through the interstices of the layer. Conduction will stop when pressure is removed and the element returns to its quiescent state.

In either such arrangement, if a pressure-sensitive conductive polymer, powder or granule is used, the resistance will decrease as the pressure increases.

In a second aspect the invention relates to electrically conductive pathways in or on conductive polymer compositions to allow electrical connectivity to, from and between areas or points thereon. Such compositions and forms thereof, the subject of the above cited patent applications and of other aspects of the invention, alter their electrical resistance when a load is applied. On an inflexible backing such as rigid metal or plastic the applied load effects mechanical movement of the polymer composition limited by the relative inflexibly of the backing. However, on a flexible backing such as flexible plastic, fibrous material or foam, mechanical action on the coating will be further modified by the mechanical response of the backing.

The invention in this aspect uses this effect in systems such as other aspects of the invention and, in general, to provide connective paths allowing changes of resistance to be monitored away from the point of application of the actuating force. It has been found that a convenient method to produce conductive or semi-conductive paths on or within the sheets and structures is by applying and maintaining a stress along the route of the required conductive path.

According to the invention in this second aspect an electrical component comprises a body of a material capable of increasing its electrical conductance when stressed, said body characterised by at least one localised region pre-stressed to permanent conductance and adapted for external electrical connection.

A number of ways have been found to do this:

1. To conductive polymer composition in its final shape or form but before it is cross-linked, stress can be applied to the area of the required pathway during the cross-linking process. Such stress can be mechanical or electrical, directly applied or induced and can include pressure, heat, electromagnetism and other sources of radiation. Some of these stresses may themselves induce cross-linking along the required conductive path but some polymers will require a separate cross-linking operation to be carried out at the same time or after the formation of the conductive path.

2. After production and cross-linking, a permanent stress can be created along the required conductive path. This can be done by causing the path to shrink using a focussed source of radiation. This can be followed by mechanical compression of the irradiated pathways to consolidate the conductive content and improve the final conductance of the path.
3. Laying polymer or adhesive, which shrinks as it cross-links or dries, on top of or within the conductive polymer composition or structure, would make the underlying. polymer composition conductive.
4. In sheets of conductive polymer composition and materials coated with conductive polymer composition a line of stitching can apply sufficient force within and between the stitches to create a conductive path. Thin plastic foams coated with conductive granules are particularly good materials for this form of the invention and flexible, touch-sensitive circuits can be produced by this method. The thread used for the stitching can be of a standard non-conductive type and the size and tension of the stitch has an effect on the final resistance of the path. Threads containing conductive material can be used if paths with very low resistance are required. Sheets can be produced with conductive tracks with an open-cell foam or other dielectric to keep the sheets apart until an actuating pressure is applied to bring the sheets into mutual conduction.

The invention in its third aspect relates to polymeric sensing materials and in particular to a sensor based on the stress-sensitive electrically conductive polymer compositions such as those detailed in the above cited prior patent applications.

Surprisingly it has been found that the above mentioned polymer compositions, modified polymers and structures, change electrical property by interaction with chemical, biological species, nuclear and electromagnetic fields. The change in electrical property is reversible and may give a measure of concentration of radiation flux.

According to the invention a sensor for chemical species or biological species or radiation comprises:

a) a contacting head presenting a polymer composition comprising at least one substantially non-conductive polymer and at least one electric conductive filler and being electrically insulating when quiescent but conductive when subjected to mechanical stress or electrostatic charge;
b) means for access of a test specimen to the head;
c) means to connect the head into an electrical circuit effective to measure an electrical property of the polymer composition.

It is noted that in the polymer composition the encapsulant phase is highly negative on the triboelectric series, does not readily store electrons on its surface and is permeable to a range of gases and other mobile molecules into the head and/or onto its surface, thus changing the electrical property of the polymer composition.

In the contacting head the polymer composition may be for example in any of forms (a) to (c) above.

The contacting head may include stressing means, for example mechanical compressing or stretching or a source of electric or magnetic field, to bring the polymer composition to the level of conductance. appropriate to the required sensitivity of the sensor.

The sensor may afford static or dynamic contacting. For static contacting it may be a portable unit usable by dipping the head into the specimen in a container. For dynamic conducting, it may be supported in a flowing current of specimen or may include its own feed and/or discharge channels and possibly pump means for feeding and or withdrawing specimen. Such pump means is suitably peristaltic as, for example in medical testing.

In one example the properties of the system change in real time. That is, under the influence of a non-uniform electric field the particles experience an electrophoretic force which changes the electrical property of the polymer structure.

In a preferred sensor the polymer composition is excited by a linear or non-linear AC field. A range of techniques may be used to distinguish the signal of interest from noise and from interfering signals, for example—reactance, inductance, signal profile, phase profile, frequency, spatial and temporal coherence.

In another example the polymer composition is held in a transient state by application of an electric charge; then increased ionisation as a consequence of exposure to nuclear radiation changes the electrical resistivity, reactance, impedance or other electrical property of the system.

In a further example a complexing ionophore or other lock and key or adsorbing material is incorporated within the polymer composition. Such materials include crown ethers, zeolites, solid and liquid ion exchangers, biological antibodies and their analogues or other analogous materials. When excited by a DC, linear AC or non-linear AC field, such materials change their electrical property in accordance with the adsorption of materials or contact with sources of radiation. Such materials offer the potential to narrow the bandwidth for adsorbed species and selectivity of the system. In a yet further example an electride, that is a material in which the electron is the sole anion, a typical example of which might be caesium-5-crown-5 prepared by vaporising caesium metal over 15-crown-5, is incorporated within the polymer composition. Other ionophore, zeolite and ion exchange materials might be similarly employed. Such a composition has a low electron work function, typically $<<1$ electron-volt, such that low DC or non-uniform AC voltages switch it from insulative to conductive phase with decreasing time constant and increasing the bandwidth for adsorbed species and of the system. Such materials may be used to detect the presence of adsorbed materials and or radiation sources.

BRIEF DESCRIPTION OF THE DRAWINGS

Preferred forms of the invention are described more fully with reference to the accompanying drawings, in which.

Figure 1:
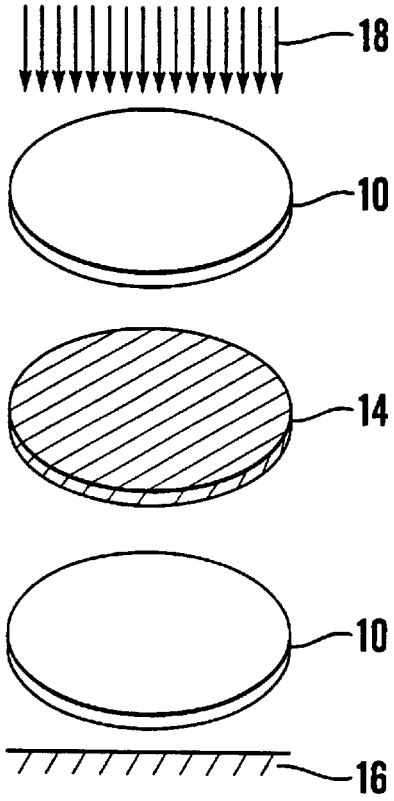
FIG. 1 is an exploded view of a variable resistor shaving a flexible or rigid external connecting means.

Any of the variable resistors shown in the drawings may form the basis of a sensor according to a third aspect of the invention.

DETAILED DESCRIPTION OF THE INVENTION

EXAMPLE

An example of a conductive foam structure for the element is as follows: a polyether open-cell foam sheet 2 mm thick and 80 ppi (32 pores per cm) cell size, is loaded with nickel/silicone coated granules in the size range 75–152 microns. The granules were prepared by coating INCO nickel powder type 287 with ALFAS INDUSTRIES RTV silicone type A2000 in the proportions 8/1 by weight using rotary ablation. The granules were sieved to size and rubbed into the foam until they appeared on the underside of the foam which is an indication of correct filling. The foam held 75 mg of granules per $cm^2$, corresponding to 1875 $mg/cm^3$ on average through the foam after compression and about 2500 $mg/cm^3$ in the fully loaded stratum constituting the element. The foam containing the granules was compressed between metal sheets and heated in an oven at 120C for 30 min. This process produced a very pliable pressure sensitive structure 0.4 mm thick, which has a resistance range of more than $10^{12}$ ohms across the thickness and which could be proportionally controlled down to less than one ohm using only finger pressure.

Referring to the figures generally:

the words 'upper' and 'lower' relate only to positioning on the drawings, without limitation to disposition when in use;

the circular shape of the components is illustrative only and other shapes will be chosen to suit intended use; for example a rectangular shape would be appropriate for a contacting head in the third aspect of the invention to provide a path for circulation of a fluid test specimen.

Referring to FIG. 1, the variable resistor comprises external connection means comprising electrodes 10 from which extend external connectors not shown. Electrodes 10 are bridged by element 14 consisting of nickel/silicone-carrying foam as described in the Example above. Lower electrode 10 is supported on solid base 16. Upper electrode 10 is movable downwards to compress element 14, under the action of means 18 indicated generally by arrows and capable of action over part or all of the area of electrode 10. It would of course be possible to apply means 18 also to the lower electrode. Electrode 10 may be a distinct member made of hard material such as metallic copper or platinum-coated brass: in that event the action over part of the electrode area may be for example by sloping the application of means 18 to electrode 10, or by using an element 14 of graded thickness. Alternatively electrode 10 may be flexible, for example metal foil, metal-coated cloth, organically conductive polymer, or, in a preferred switch, a coherent coating of conductive metal on the upper and/or lower surface of element 14. Such a coating may be provided by application of metal-rich paint such as silver paint. In this variable resistor, element 14 may structurally be based on any other material having appropriate interstices, for example on a thick-weave polyester cloth such as cavalry twill or on worsted.

Figure 2A:
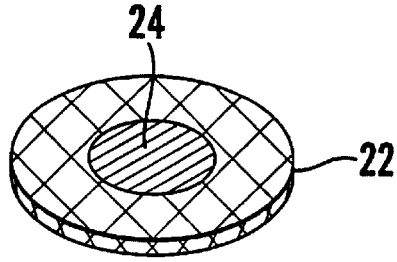
FIG. 2 shows three variants of the element shown in FIG. 1.
Figure 2B:
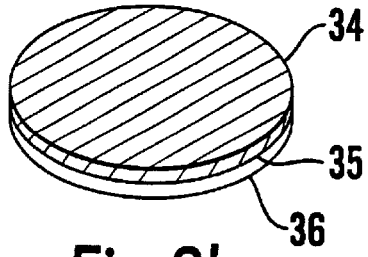
Figure 2C:
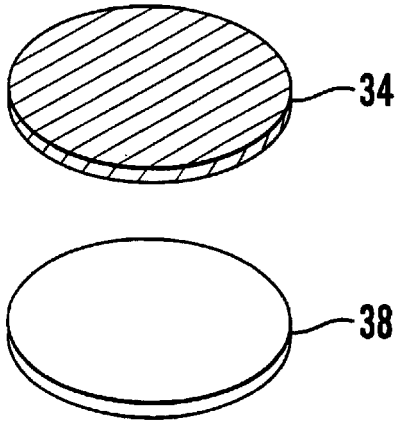

Referring to FIG. 2, the general construction of the variable resistor is the same as in FIG. 1, but three variants 2*a*–2*c* of the element are presented.

In variant 2*a* the element, numbered 22, carries carbon throughout its volume 22+24 and nickel/silicone granules only in central region 24. When the switch is quiescent, with no stress applied by means 18, it permits the passage of a small current by the weak conductance of the carbon, thus providing a 'start-resistance' or 'start-conductance'. When stress is applied by means 18, the strong conductance of the nickel/silicone composition comes into play, to an extent depending on the area over which such stress is applied, as well as on the extent of compression of the composition if it has this property.

Variants 2*b* and 2*c* show combinations of the element with a matching layer of non-conductive or weakly conductive material.

In variant 2*b* the element, numbered 34, is provided by the nickel/silicone-carrying upper part of a block of foam or textile, the lower part being a non-conductive or (e.g. as in 2*a*) weakly conductive layer. This combination is made by applying nickel/silicone as powder or liquid suspension preferentially to one side of the block. The boundary between the element and the layer need not be sharp.

In variant 2*c* the element, numbered 34, may carry nickel/silicone uniformly or gradedly, but the layer, numbered 38, is a distinct member and may, in the assembled switch, be adhered or mechanically held in contact with element 34. This has the advantage over 2*b* that the layer may be structurally different from the element, eg:

element layer collapsed foam non-collapsed foam

. . . woven cloth

. . . net collapsed cloth non-collapsed cloth

Figure 3A:
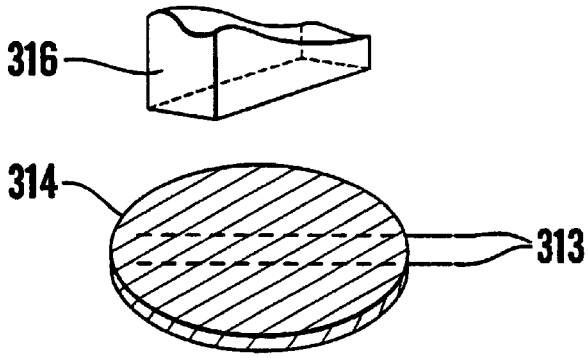
FIG. 3 shows two variable resistors having a configuration of element and external connections different from those of FIGS. 1 and 2; these optionally use connectors according a second aspect of the invention.
Figure 3B:
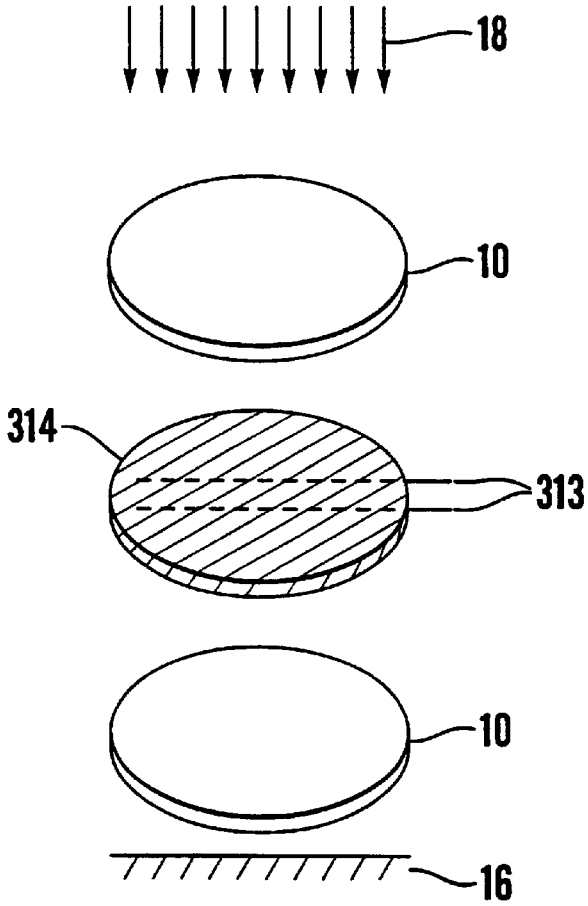

Referring to FIGS. 3*a* and 3*b*, the element comprises a block 314 of foam carrying nickel/silicone and having external connecting conductors 313 embedded in it. The element may be brought to conductance by compressing a region between conductors 313 by downward action of shoe 316, which may have an oblique lower end so that its area of application to the element depends on the extent of its downward movement. Instead or in addition, shoe 316 may comprise a plurality of members individually controllable to permit a desired aggregate area of application. In a miniaturised variable resistor shoe 316 may be a dot-matrix or piezo-electric mechanism. The embedded conductors may be made of ohmic material, or can be tracks of metal/polymer composition, for example nickel/silicone, made permanently conductive by local compression by for example shrinkage or stitching. If the embedded conductors are produced by localised compression, this may be effected in a relatively thin sheet of element, whereafter a further sheet of element may be sandwiched about that thin sheet.

A variable resistor as in FIG. 3*a*, when used as a sensor according to the third aspect of the invention, may conveniently form part of a static system in which it is immersed in a fluid specimen, as well as being usable in a flow system.

The variable resistor shown in FIG. 3*b* is a hybrid using the mechanisms of FIG. 1 and FIG. 3*a*. It is more sensitive than the variable resistor of FIG. 3*a*. When compression is applied at 18, conduction between conductors 313 can take place also via electrode 10.

Figure 4A:
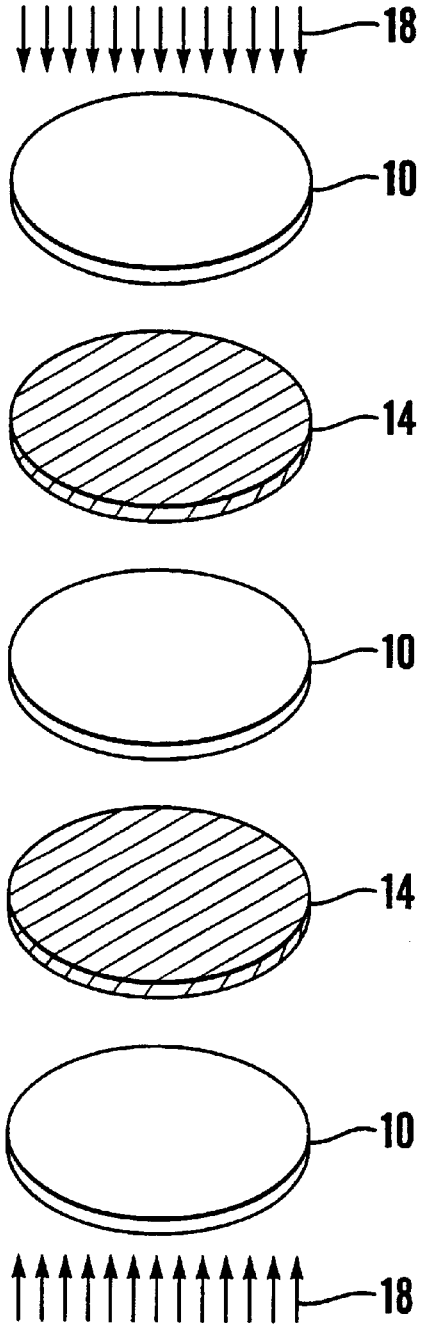
FIG. 4 shows exploded views of two multi-function variable resistors.
Figure 4B:
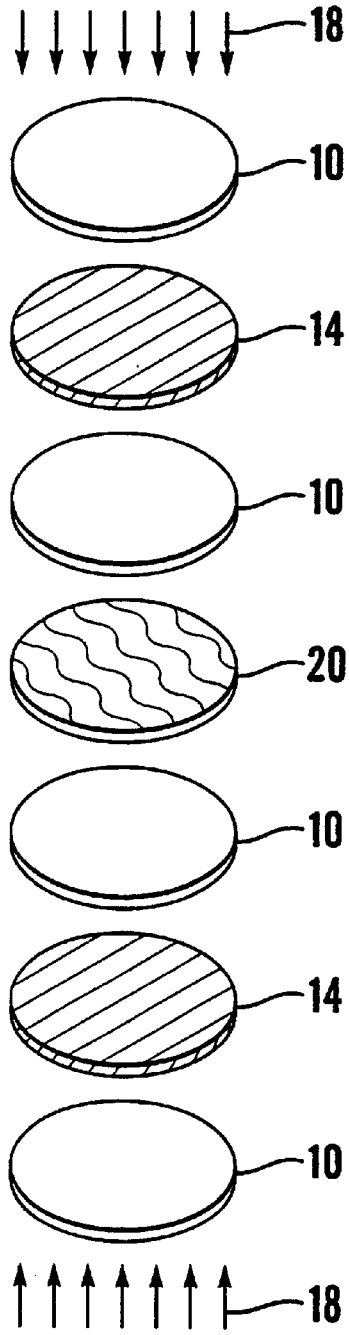

Referring to FIGS. 4, 4*a* shows a variable resistor that is effectively two FIG. 1 variable resistors back to back. The arrangement of two variable resistance outputs from a single input is provided much more compactly than when using conventional variable resistor components. The FIG. 4*a* combination when used in a sensor may provide a test reading and blank reading side-by-side. FIG. 4*b* shows an arrangement in which two separate variable resistors each as FIG. 1 are electrically insulated from each other by block 20. In 4*a* and 4*b* the variants in FIGS. 2 and 3 may be used. Such combinations are examples of compact multi-functional control means affording new possibilities in the design of electrical apparatus. In a simple example, the 4*b* arrangement could provide an on/off switch and volume control operated by a single button.

What is claimed is:

1. A variable electrical conductance composite having a first level of electrical conductance when quiescent and a second level of conductance upon change of mechanical or electrical stress applied to said composite, said composite comprising a collapsible body of an insulating or weakly conductive material containing interstices that contain granules of an insulating or weakly conductive polymer containing particles of at least one strongly conductive material selected from the group consisting of metals, alloys and reduced metal oxides, said granules having such a loading of said strongly conductive material that said granules themselves have a first level of electrical conductance when quiescent and a second level of conductance upon change of mechanical or electrical stress applied to said granules.

2. A variable electrical conductance composite according to claim 1 in which the collapsible body comprises at least one material selected from the group consisting of foam, net, gauze, mat and cloth.

3. A variable electrical conductance composite according to claim 2 which is the product of loading cells of an open-cell polymer foam with particles of the strongly conductive material and collapsing the loaded foam by a factor which is in the range 2 to 8 by volume but leaves it capable of further compression.

4. A variable electrical conductance composite according to claim 1 wherein the concentration of the strongly conductive material in said collapsible body is graded.

5. A variable electrical conductance composite according to claim 1 in which the collapsible body is weakly conductive and formed from a polymer containing finely divided carbon.

6. A variable electrical conductance composite according to claim 1 in a sheet-like configuration of thickness 0.1 mm to 5.0 mm.

7. A variable electrical conductance composite according to claim 1 in which the granules comprise the particles mixed with a non-conductive elastomer.

8. A variable electrical conductance composite according to claim 7 in which the volumetric ratio of particles to elastomer within the granules is at least 0.1:1.

9. A variable electrical conductance composite according to claim 1 in which the particles have a surface texture comprising at least one of a spiky surface texture and a dendritic surface texture and/or a filamentary.

10. A variable electrical conductance composite according to claim 9 in which the particles comprise carbonyl-derived metallic nickel.

11. A variable electrical conductance composite according to claim 7 in which the elastomer is a silicone rubber.

12. A variable electrical conductance composite according to claim 7 in which the ingredient volumetric ratio of particles to elastomer is at least 1:1, the particles being mixed with the elastomer in a controlled manner, in a mixing regime avoiding destructive shear forces, whereby the particles are dispersed within and encapsulated by the elastomer and may remain structurally intact, the nature and concentration of the particles being such that the electrical resistivity of the granules is variable in response to compression or extension forces and decreases from a given value in the quiescent state towards a value substantially equal to that of the conductor bridges of the particles when subjected to either compression or extension forces, the granules further comprising a modifier which, on release of said forces, accelerates the elastic return of the granules to their quiescent state.

13. A variable electrical conductance composite according to claim 6 including a collapsible layer of an insulating or weakly conductive material containing interstices that are accessible to mobile fluid and which are free of said particles.

14. A variable electrical conductance composite according to claim 1 wherein said interstices are accessible to mobile fluid.

15. A variable electrical conductance composite according to claim 1 in which the particles have a filamentary structure.

16. A variable resistor having a first level of electrical conductance when quiescent and a second level of conductance upon change of mechanical or electrical stress applied to said resistor, said resistor comprising externally connectable electrodes bridged by a collapsible body of an insulating or weakly conductive material containing interstices that contain granules of an insulating or weakly conductive polymer containing particles of at least one strongly conductive material selected from the group consisting of metals, alloys and reduced metal oxides, said granules having such a loading of said strongly conductive material that said granules themselves have a first level of electrical conductance when quiescent and a second level of conductance upon change of mechanical or electrical stress applied to said granules.

17. A variable resistor according to claim 16 including means effective to perform at least one of the following functions:

a) to apply conductance increasing stress to the region of said collapsible body bridging said electrodes, b) to reverse conductance increasing stress to the region of said collapsible body bridging said electrodes, and c) to act against pre-existing conductance increasing stress; to the region of said collapsible body bridging said electrodes.

18. A variable resistor according to claim 13 and including external connection by way of at least one localized region of the collapsible body pre-stressed to conductance.

19. A variable resistor according to claim 18 in which the collapsible body is in sheet form and the pre-stressed region is provided by a line of stitching.

20. A variable resistor according to claim 16 having externally connectable bridged electrodes embedded in the collapsible body.

21. A variable resistor according to claim 16 wherein the concentration of the strongly conductive material in said collapsible body is graded.

22. A plurality of variable resistors according to claim 16 sandwiched together and actuated by a single mechanical stressing means.

23. A plurality of variable resistors according to claim 22 including insulating means whereby the resistors are electrically insulated from each other.

24. A variable resistor according to claim 16 wherein said interstices are accessible to mobile fluid.

25. A variable resistor according to claim 24 in which the collapsible body is at least one material selected from the group consisting of foam, net, gauze, mat and cloth.

26. A variable resistor according to claim 25 in which the collapsible body is the product of loading cells of an open-cell polymer foam with particles of the strongly conductive material and collapsing the loaded foam by a factor which is in the range 2to 8 by volume but leaves it capable of further compression.

27. A chemical sensor comprising:

a) a contacting head including a variable resistor having a first level of electrical conductance when quiescent and a second level of conductance upon change of mechanical or electrical stress applied to said resistor, said resistor including externally connectable electrodes bridged by a collapsible body of an insulating or weakly conductive material containing interstices that are accessible to mobile fluid and contain granules of an insulating or weakly conductive polymer containing particles of at least one strongly conductive material selected from the group consisting of metals, alloys and reduced metal oxides, said granules having such a loading of said strongly conductive material that said granules themselves have a first level of electrical conductance when quiescent and a second level of conductance upon change of mechanical or electrical stress applied to said granules, b) means for access of a mobile fluid containing the chemical to be sensed to the head, and c) means to connect the electrodes into an electrical circuit effective to detect a variation in conductance of said resistor.

28. A sensor according to claim 27 in which the contacting head includes stressing means to bring the variable resistor to the level of conductance appropriate to the required sensitivity of the sensor.

* * * * *